US005456503A

United States Patent [19]

Russell, IV

[11] Patent Number: 5,456,503

[45] Date of Patent: Oct. 10, 1995

[54] TRANSFER ADJUSTABLE BACKSET

[75] Inventor: Charles C. Russell, IV, Elm Grove, Wis.

[73] Assignee: Master Lock Company, Milwaukee, Wis.

[21] Appl. No.: 262,004

[22] Filed: Jun. 17, 1994

[51] Int. Cl.[6] ..... L05C 1/16

[52] U.S. Cl. ..... 292/1.5; 292/169; 292/DIG. 60

[58] Field of Search ..... 292/1.5, 169, 337, 292/DIG. 60; 70/461

[56] References Cited

U.S. PATENT DOCUMENTS

| | | | |
|---|---|---|---|
| 4,372,594 | 2/1983 | Gater | 292/337 |
| 4,664,433 | 5/1987 | Solovieff | 292/DIG. 60 X |
| 4,708,379 | 11/1987 | ching | 292/337 |
| 4,725,086 | 2/1988 | Shen | 292/337 |
| 4,729,586 | 3/1988 | Fang | 292/337 |
| 4,752,090 | 6/1988 | Lin | 292/1 |
| 4,767,140 | 8/1988 | Lin | 292/337 |
| 4,895,404 | 1/1990 | Toledano | 292/DIG. 60 X |
| 4,902,057 | 2/1990 | Ching | 292/337 |
| 4,921,290 | 5/1990 | Dietrich | 292/337 |
| 4,950,008 | 8/1990 | Fang | 292/337 |
| 4,957,315 | 9/1990 | Lin | 292/337 |
| 4,976,122 | 12/1990 | Doolan et al. | 70/461 X |
| 4,979,768 | 12/1990 | Morotto et al. | 292/337 |
| 5,364,138 | 11/1994 | Dietrich et al. | 292/1.5 |

*Primary Examiner*—Peter M. Cuomo
*Assistant Examiner*—Monica E. Millner
*Attorney, Agent, or Firm*—Dorn, McEachran, Jambor & Keating

[57] ABSTRACT

An adjustable backset deadbolt has a casing formed of a sleeve assembly and a rear case. These two elements are independently adjustable to two different backset positions. A deadbolt is movable within the sleeve assembly between extended and retracted positions. There is a swivel rotatably mounted in the rear case and connected by a retractor to a pair of spaced adjustable backset openings in a rearward extension of the deadbolt. Rotation of the swivel provides translational movement of both the retractor and the deadbolt between the extended and retracted positions. The backset adjustment of the deadbolt is brought about by moving the retractor to one of two openings in the deadbolt extension and this adjustment is independent of the adjustment of the backset length of the casing.

9 Claims, 2 Drawing Sheets

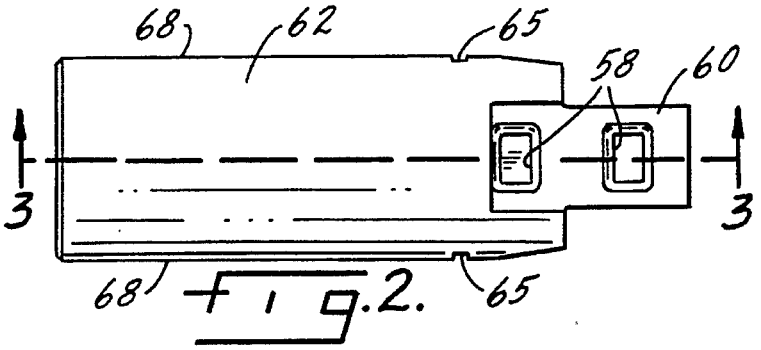
Fig. 2.
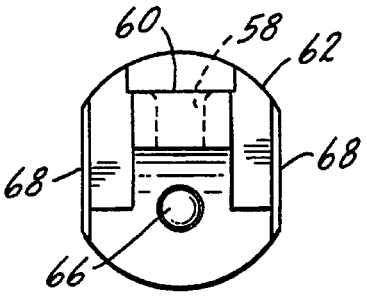
Fig. 4.
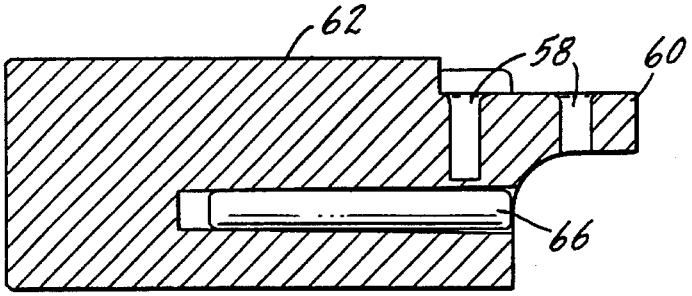
Fig. 3.
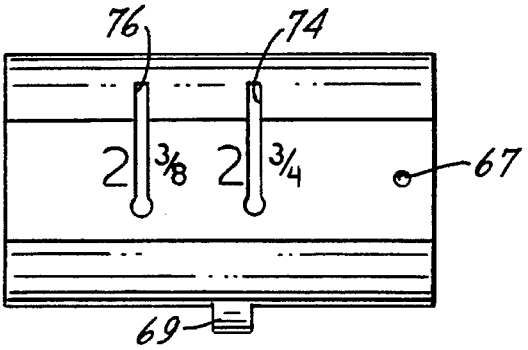
Fig. 5.
Fig. 6.
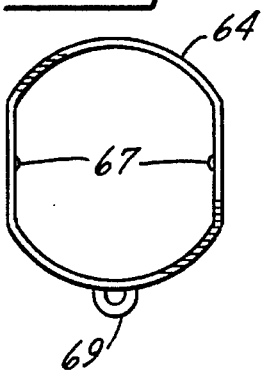
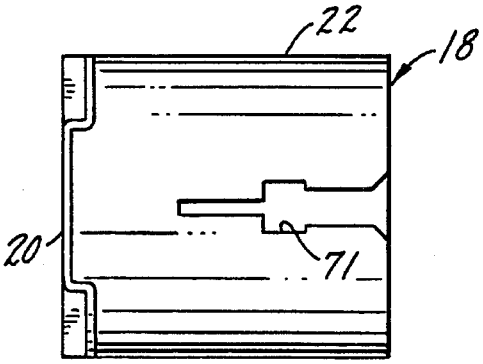
Fig. 7.

TRANSFER ADJUSTABLE BACKSET

THE FIELD OF THE INVENTION

The present invention relates to adjustable backset deadbolts of the type in which both the lock casing and the length of the deadbolt are adjustable between two different fixed backset lengths, commonly 2⅜" and 2¾". In most prior art adjustable backset deadbolts or deadlatches, adjustment of bolt length and casing length is done simultaneously by an internal mechanism linking the two backset adjustments. Coordinated movements of this type are complex, require many costly components and often compromise the reliability, strength and cost effectiveness, as well as the ease of installation of the lock assembly. The present invention provides adjustable backset in which the length of the bolt and the length of the lock casing are independently adjustable between two fixed backset positions.

SUMMARY OF THE INVENTION

The present invention relates to an adjustable backset deadbolt and in particular to one in which the backset distance of the bolt and the lock casing are independently adjustable.

Another purpose of the invention is to provide an adjustable backset lock assembly which is simple in construction and reliable in operation.

Another purpose of the invention is to provide an adjustable backset deadbolt in which bolt backset adjustment is provided by placing a retractor in one of two openings in a bolt rearward extension.

Another purpose of the invention is to provide an adjustable backset lock assembly in which the casing is moved to one of two backset adjustment positions by separating the casing components and moving them relative to each other to one of the two backset positions.

Other purposes will appear in the ensuing specification, drawings and claims.

BRIEF DESCRIPTION OF THE DRAWINGS

The invention is illustrated diagrammatically in the following drawings wherein:

FIG. 2 is a top view of the deadbolt;

FIG. 3 is a side view of the deadbolt;

FIG. 4 is a rear view of the deadbolt;

FIG. 5 is a side view of the sleeve assembly;

FIG. 6 is a rear view of the sleeve assembly; and

FIG. 7 is a bottom view of the back plate.

DESCRIPTION OF THE PREFERRED EMBODIMENT

Figure 1:
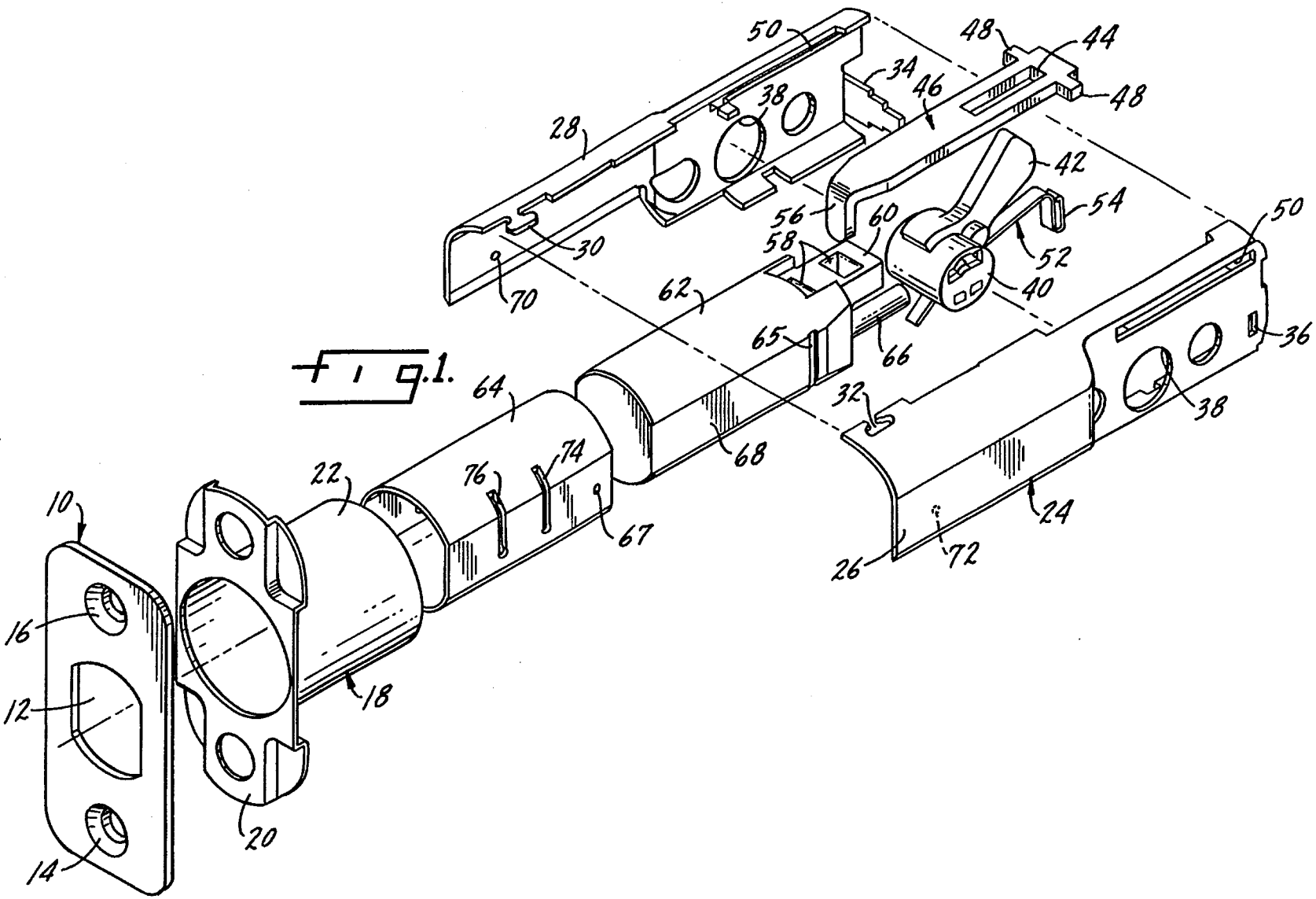
FIG. 1 is an exploded perspective illustrating the adjustable backset lock assembly of the present invention.

The present invention will be described in connection with an adjustable backset deadbolt. The concepts and principles disclosed are equally applicable to an adjustable backset deadlatch. As is well known in the art, there are two commonly used backset distances in the building trade: 2⅜" and 2¾". In order to avoid stocking lock assemblies of differing backset distances, it has been common to have adjustable backset deadbolts and deadlatches. The most recent trend in such devices is to have coordinated adjustment of bolt length and casing length so that with one manipulation of the lock assembly both the length of the bolt and the length of the casing are simultaneously adjustable between the two possible backset distances. However, such coordinated movements require additional parts, making the lock assembly more expensive. Further, such coordinated movement requires a complex mechanism to coordinate and interlock the backset adjustment mechanisms for both the bolt and the casing, having effect on the reliability and complexity of the lock assembly. The present invention provides a simply constructed, reliable, adjustable backset deadbolt in which bolt length and casing length are independently adjustable through two easily performed separate movements.

In the drawings, the lock assembly includes a face plate 10 having a central opening 12 for the passage of the bolt and a pair of holes 14 and 16 which normally will accept threaded fastening means such as screws to attach the lock assembly to the door. The face plate 10 may either have rounded or square corners, depending upon the type of door to which the lock assembly will be mounted.

Directly adjacent to the face plate 10 is a back plate 18 which itself has a face element 20 which supports the face plate 10 when the lock is assembled and mounted onto a door. The back plate 18 further has a cylindrical portion 22 which will be used to hold the backset adjustable portions of the lock assembly casing into an adjustable backset position. There is a rear case 24 having right-hand and left-hand sections 26 and 28, respectively, which will be joined together by a projection 30 on left case half 28 and a cooperating opening 32 on right case half 26. There is further a rear arm 34 which will pass through an aligned opening 36 on the right case half 26, after which this element will be staked over to hold the two rear case halves into a joined rear case unit 24.

The rear case 24 has aligned circular openings 38 which rotatably mount a swivel 40 having an arm 42 which will extend through a cooperating opening 44 in a retractor 46. The retractor 46 has outwardly-extending arms 48 which will ride in longitudinally extending slots 50 in each side of the rear case 24, thus defining a path of translational movement for the retractor. A spring 52 is positioned beneath the swivel and has a rear portion thereof 54 which will be in engagement with the arm 34 of the left case half 28 after the two case halves are assembled into the unit 24. The spring tends to bias the swivel in a counterclockwise direction.

The retractor 46 extends forwardly and has a downwardly-extending hook 56 which is positionable in one of two backset adjustment slots 58 formed in a rearward extension 60 of bolt 62. The bolt 62 extends forwardly into a sleeve assembly 64 which in turn will be positioned inside of the rear case 24. The sleeve assembly has a downward tab 69 which will move within a slot 71 in the bottom of back plate 18 when the lock is disassembled during backset adjustment.

The bolt 62 has a rearwardly-extending hardened antisaw pin 66, as is conventional in deadbolts, and has a pair of parallel generally vertical side walls 68. The side walls 68 define a bolt cross section which matches that of the rear case 24 which also has vertically extending side walls as does the sleeve assembly 64. Thus, the cross sectional configuration of the bolt, rear case and sleeve assembly all match, confining the bolt to purely translational movement. The bolt 62 has vertical grooves 65 in side walls 68, which grooves are positioned to receive inward projections 67 on the inside of sleeve assembly 64. This combination of elements is sufficient to hold the bolt and sleeve assembly together during backset adjustment.

When the bolt is to be operated, the swivel will be rotated in either a counterclockwise or clockwise direction, depending upon whether the bolt is to be extended or retracted. The arm 42 of the swivel 40 will drive the retractor 46 in a translational direction and the retractor and bolt will move simultaneously in the same direction inside of the sleeve assembly 64. The bolt will move either outwardly from face plate 10 or rearwardly into the face plate 10, depending upon the rotational direction of the swivel 40.

In order to adjust backset for the deadbolt shown, the bolt is first moved to the retracted position. The back plate 18 is then held in one hand and the casing assembly made up of the rear case 24 and the sleeve assembly 64 is held in the other hand. The back plate may then be pulled away from the casing, tab 69 moving in slot 71. At this point the rear case 24 may be moved upwardly away from the sleeve assembly 64. The rear case 24 has a pair of inwardly-directed projections 70 and 72, one on each of the rear case halves. These projections ride in one of two spaced slots 74 and 76 formed in the sleeve assembly 64. There are a pair of spaced slots on each side of the sleeve assembly. When the rear case has been moved upwardly from the particular backset position in which it was in, by permitting the projections 70 and 72 to move upwardly in either of slots 74 and 76, the rear case is then separated from the sleeve assembly and bolt. At this point the retractor hook 56 may be removed from either of the two backset adjustment slots 58 and placed in a desired slot or opening. After the retractor has been so positioned, the rear case and sleeve assembly are rejoined in a backset position consistent with that of the bolt and retractor.

Backset adjustment between the rear case and sleeve assembly is brought about by moving the projections 70 and 72 on the inside of the rear case so that these projections are positioned in one of the two backset adjustment slots on each side of the sleeve assembly. In like manner, backset adjustment of bolt length is brought about by moving the retractor hook 56 to one of the two openings in the rearward extension of the bolt 60. The mechanism is simple, reliable, and requires only a few movements to change the lock assembly from one backset length to another.

Whereas the preferred form of the invention has been shown and described herein, it should be realized that there may be many modifications, substitutions and alterations thereto.

The embodiments of the invention in which an exclusive property or privilege is claimed are defined as follows:

1. An adjustable backset deadbolt including a sleeve assembly, a deadbolt movable within said sleeve assembly between extended and retracted positions, a rear case adjustably mounted onto said sleeve assembly, a swivel rotatably mounted in said rear case, a retractor movable in said rear case and in engagement with said swivel and adjustably attached to said bolt, rotation of said swivel causing translational movement of said retractor and bolt to thereby move said bolt between extended and retracted positions, backset adjustment means on said bolt and retractor including spaced openings on said bolt and a cooperating engagement means on said retractor positionable in either of said spaced openings, with each opening being arranged to provide for bolt extension at a specific backset, backset adjustment means on said sleeve assembly and rear case, operable independently of the backset adjustment means on said bolt and retractor, said sleeve assembly and rear case backset adjustment means including means thereon for permitting relative movement therebetween, independent of backset adjustment movement between said bolt and retractor, and for engaging said sleeve assembly and rear case in one of two backset positions in which the combined length of the engaged sleeve assembly and rear case is different.

2. The adjustable backset deadbolt of claim 1 characterized by a cylindrical back plate extending about said sleeve assembly, removal of said cylindrical back plate being required prior to backset adjustment of said sleeve assembly and rear case.

3. The adjustable backset deadbolt of claim 2 characterized in that said back plate has a front face thereon through which the deadbolt extends when in the extended position.

4. The adjustable backset deadbolt of claim 2 characterized in that said sleeve assembly has a pair of spaced parallel slots, each for a particular backset position, with said rear case having an inwardly extending projection, positionable in either of said slots.

5. The adjustable backset deadbolt of claim 4 characterized in that there are a pair of generally vertically extending spaced slots on each side of said sleeve assembly, there being a cooperating projection on each side of said rear case for use in adjusting backset of said combined sleeve assembly and rear case.

6. The adjustable backset deadbolt of claim 4 characterized in that said rear case extends about said sleeve assembly and said back plate extends about said rear case.

7. The adjustable backset deadbolt of claim 2 characterized in that said sleeve assembly is in part cylindrical with generally flat sides, said deadbolt being movable within said sleeve assembly, said rear case extending about said sleeve assembly and having generally flat sides which correspond to the flat sides of said sleeve assembly, said back plate being generally cylindrical and extending about said rear case.

8. The adjustable backset deadbolt of claim 1 characterized in that said deadbolt includes a rearward extension having said spaced openings, said retractor including a hook element positionable in either of said openings.

9. The adjustable backset deadbolt of claim 8 characterized in that said retractor hook element is positioned for downward extension in said bolt extension openings, said hook element being at the front end of said retractor.

* * * * *